US010688797B2

(12) United States Patent
Chalamet et al.

(10) Patent No.: US 10,688,797 B2
(45) Date of Patent: Jun. 23, 2020

(54) AGITATING INK IN A CARTRIDGE

(71) Applicant: Dover Europe Sàrl, Vernier (CH)

(72) Inventors: Daniel Chalamet, Tournon sur Rhone (FR); Loïc Frerejean, Crissier (CH)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/031,158

(22) Filed: Jul. 10, 2018

(65) Prior Publication Data

US 2018/0319171 A1 Nov. 8, 2018

Related U.S. Application Data

(63) Continuation of application No. 15/207,858, filed on Jul. 12, 2016, now abandoned.

(30) Foreign Application Priority Data

Jul. 13, 2015 (FR) ..... 15 56645

(51) Int. Cl.
*B41J 2/01* (2006.01)
*B41J 2/175* (2006.01)

(52) U.S. Cl.
CPC ..... *B41J 2/17553* (2013.01); *B41J 2/175* (2013.01); *B41J 2/17536* (2013.01); *B41J 2/17559* (2013.01)

(58) Field of Classification Search
None
See application file for complete search history.

(56) References Cited

U.S. PATENT DOCUMENTS

| | | | | |
|---|---|---|---|---|
| 5,137,175 | A * | 8/1992 | Kowalski | B65D 77/067 222/1 |
| 5,451,987 | A * | 9/1995 | Perrin | B41J 2/195 347/6 |
| 6,065,828 | A | 5/2000 | Lo | |
| 6,224,201 | B1 | 5/2001 | Shigemura | |
| 6,352,324 | B1 | 3/2002 | Pagnon | |
| 2003/0122907 | A1 | 7/2003 | Kim | |
| 2004/0137652 | A1 | 7/2004 | Ishii | |
| 2006/0268080 | A1 * | 11/2006 | Nakazawa | B41J 2/17509 347/86 |
| 2008/0186369 | A1 * | 8/2008 | Lyles | B41J 2/17509 347/87 |

(Continued)

FOREIGN PATENT DOCUMENTS

| | | |
|---|---|---|
| EP | 0 968 831 A1 | 1/2000 |
| EP | 1 083 054 A1 | 3/2001 |

(Continued)

OTHER PUBLICATIONS

Harada, Nobuhiro, Inkjet Recording Device, Apr. 2015, WO, (Year: 2015).*

(Continued)

*Primary Examiner* — Matthew Luu
*Assistant Examiner* — Tracey M McMillion
(74) *Attorney, Agent, or Firm* — Pearne & Gordon LLP

(57) ABSTRACT

The invention relates to an ink cartridge (30) for a CIJ type printer, such a cartridge including at least one volume (14) delimited by a shell, a sealed aperture (16) of the shell, a fluid ink (17) and magnetic means (15) movable with respect to the cartridge shell.

24 Claims, 11 Drawing Sheets

(56) References Cited

U.S. PATENT DOCUMENTS

| | | | | |
|---|---|---|---|---|
| 2010/0112815 | A1* | 5/2010 | O'Dougherty ..... | B67D 7/0261<br>438/689 |
| 2011/0280098 | A1 | 11/2011 | Shiono | |
| 2011/0310194 | A1 | 12/2011 | Takagi | |
| 2012/0127243 | A1 | 5/2012 | Kumagai | |
| 2014/0240422 | A1 | 8/2014 | Suzuki | |
| 2014/0362147 | A1 | 12/2014 | Blowfield et al. | |

FOREIGN PATENT DOCUMENTS

| | | | |
|---|---|---|---|
| EP | 2 361 772 | A2 | 8/2011 |
| EP | 2 511 098 | A1 | 10/2012 |
| JP | S60-110458 | A | 6/1985 |
| WO | 2009047501 | A1 | 4/2009 |
| WO | 2011/012641 | A1 | 2/2011 |
| WO | 2015/049918 | A1 | 4/2015 |
| WO | WO-2015049918 | A1 * | 4/2015 |

OTHER PUBLICATIONS

Search Report issued in French Patent Application No. FR 15 56645 dated Apr. 29, 2016.
Extended European Search Report issued in Patent Application No. EP 16 17 9028 dated Feb. 14, 2017.

* cited by examiner

AGITATING INK IN A CARTRIDGE

CROSS-REFERENCE TO RELATED APPLICATIONS

This is a continuation of prior U.S. application Ser. No. 15/207,858 filed Jul. 12, 2016, which claims priority of French Application No. 15 56645 filed Jul. 13, 2015. The content of each these applications is incorporated by reference herein in its entirety.

TECHNICAL FIELD AND STATE OF PRIOR ART

The invention relates to the field of printers in particular that of industrial printers using solvent inks, for example CIJ printers.

The ink circuit of these printers has removable ink and fresh solvent supplies contained in cartridges, flasks or containers.

The invention relates in particular to an ink cartridge.

The industrial printers are well known in the field of coding and industrial labelling for various products, for example to label barcodes, the expiration date on food products, or even references or distance marks on cables or pipes directly on the production line and at a high rate. Among these printers, some of them exploit technologies using solvent liquid inks they deposit on the medium/product to be printed. To operate, they need a fresh ink supply, even also a fresh solvent supply to feed printing. By way of example, continuous ink jet (CIJ) printers which belong to this printer class can be of interest.

This printer class has several standard sub-assemblies as shown in FIG. 1.

First, a printing head 1, generally offset from the body of the printer 3, is connected thereto by a flexible umbilical 2 joining the hydraulic and electrical connections required for operating the head by providing it with flexibility which facilitates integration on the production line.

The body of the printer 3 (also called a console or cabinet) usually contains three sub-assemblies:

- an ink circuit 4 at the lower portion of the console (zone 4'), which enables, on the one hand, ink to be provided to the head at a stable pressure and with a suitable quality, and on the other hand, the jet ink not used for printing to be accommodated;
- a controller 5 located at the upper portion of the console (zone 5'), capable of managing the action sequencing and performing processes enabling different functions of the ink circuit and of the head to be activated,
- an interface 6 which gives the operator means for implementing the printer and for informing about its operation.

The ink circuit can be of the type described in EP0968831, where the ink and solvent (also called an additive) supplies are removable cartridges including a semi-rigid pocket of a plastic material, compatible with the fluids in question. This principle is found in several machines marketed by actors on the market as the product lines series 7, 9020, 9030, 9232 from Markem-Imaje or series 1000 from Videojet (WO2009047501).

An example of such a cartridge 10 is represented in FIG. 2.

It includes a rigid portion 12 and a semi-rigid or flexible portion 14. The rigid portion 12 is provided with a rigid mouth (or nose) 16 enabling a hydraulic connection to be made to the ink circuit.

Generally, the entire ink contained in such an ink cartridge is transferred to the main printer tank as soon as the cartridge is installed in the same.

There arises a problem when such a full transfer is not desired to be immediately made. In the case of a pigmented ink, it is visually noticed, through the flexible part of the cartridge wall, that pigments of the ink contained in the cartridge are deposited on the walls thereof. It can be attempted to manually stir the cartridge for homogenising its content, but this is not sufficient because deposits remain on the walls. In any case, the ink taken out thereafter by the machine will have a very low pigment rate and the printing performance thereof will be degraded. Further, the pigment deposition can generate a partial plugging of the fluid connection means (conduits, valves, etc.), causing a difficulty in transferring ink because of a plugging phenomenon.

This problem can be raised in particular after a shutdown of the printer for a quite long duration, for example a few days. If the cartridge has not been fully emptied, the ink is not homogeneous therein. Once again, these deposits occur and cannot be fully suppressed.

DISCLOSURE OF THE INVENTION

In order to solve these problems, the invention first relates to an ink cartridge, for a printer, for example an industrial printer, and including at least one volume, defined by a shell, or even a pocket or a wall, a sealed aperture of this shell or pocket or wall, this cartridge containing movable, or stirrable magnetic means, with respect to the shell or the pocket.

The magnetic means can be covered with a protecting layer.

Preferably, the cartridge further includes a circuit for storing at least one datum relating to at least one physical and/or chemical property of the ink and/or at least one manufacturing and/or expiration date datum of the ink.

The cartridge can be made as an at least partly semi-rigid or deformable volume.

It has a maximum capacity which can be included in a wide range, for example between 50 $cm^3$ and 3 l, for example lower than 1 l.

The aperture of the shell or the pocket is preferably a single one: it is this that will allow fluid to be introduced into the cartridge, and then that will be sealed, and then unsealed upon use.

The invention also relates to a cartridge compartment of a CIJ printer, including:

- means for positioning a solvent cartridge and an ink cartridge, for example of the type according to the invention, as described above and/or in the present application;
- means, for example a motor and/or a magnetic element, for activating, in such an ink cartridge, the movement of magnetic means with respect to a cartridge shell.

Such a cartridge compartment can further include protecting means for the means for activating the movement of the magnetic means in the ink cartridge.

The means for activating, in the ink cartridge, the movement of the magnetic means, are preferably disposed under the volume for accommodating the ink cartridge in the printer.

The means for activating, in the ink cartridge, the movement of the magnetic means, can advantageously operate at a frequency at least equal to 225 Hz.

The means for activating, in the ink cartridge, the movement of the magnetic means, can advantageously include a step motor.

The invention also relates to a printer, for example an ink jet printer such as a CIJ continuous jet printer, that can implement one or more cartridges, in particular an ink cartridge according to the invention.

The invention also relates to an ink jet printer including:

a printing head;

a circuit for feeding ink and solvent to the printing head, a solvent and ink cartridge compartment as described above and/or in the present application.

Thus, an ink cartridge, for example of the type according to the invention, as described above and/or in the present application, can be connected to the circuit for feeding ink of the ink jet printer.

Means can be provided to pump the remaining ink of the cartridge, as soon as a minimum ink volume is reached in the cartridge.

Means can be provided for activating the movement of the magnetic means with respect to the cartridge shell, during a printing operation and/or between printing operations and/or during or after a shutdown of the printer.

The invention thus also relates to a method for operating, with at least one cartridge according to the invention, a printer, in particular an ink jet printer such as a CIJ continuous jet printer.

In this method, the magnetic means of the cartridge are moved with respect to the cartridge shell and thus stir the ink in the cartridge.

Further, the remaining ink in the cartridge can be pumped, as soon as a minimum ink volume is reached in the cartridge.

Preferably, the movement of the magnetic means can be activated with respect to the cartridge shell, during a printing operation and/or between printing operations and/or during or after a shutdown of the printer.

When a cartridge according to the invention is used with a printer, this use can be shut down, the cartridge of the printer removed (while it still contains ink), and then the cartridge sealed again, and be installed on another printer.

Thus the cartridge, still containing ink, may be taken out or withdrawn from the ink feed circuit of a printer on which it is installed or with which it is in fluidic connection and be installed on, or put in fluid communication, with the ink feed circuit of another printer.

The invention also relates to a method for manufacturing an ink cartridge for a CIJ type printer, for example a cartridge according to the invention, as described above, this method including:

introducing magnetic means in the cartridge shell;

and then introducing ink into the cartridge;

and then hermetically sealing the cartridge.

After sealing, an electronic circuit, or tag, can be applied against an external wall of the cartridge.

DETAILED DISCLOSURE OF PARTICULAR EMBODIMENTS

Figure 2:
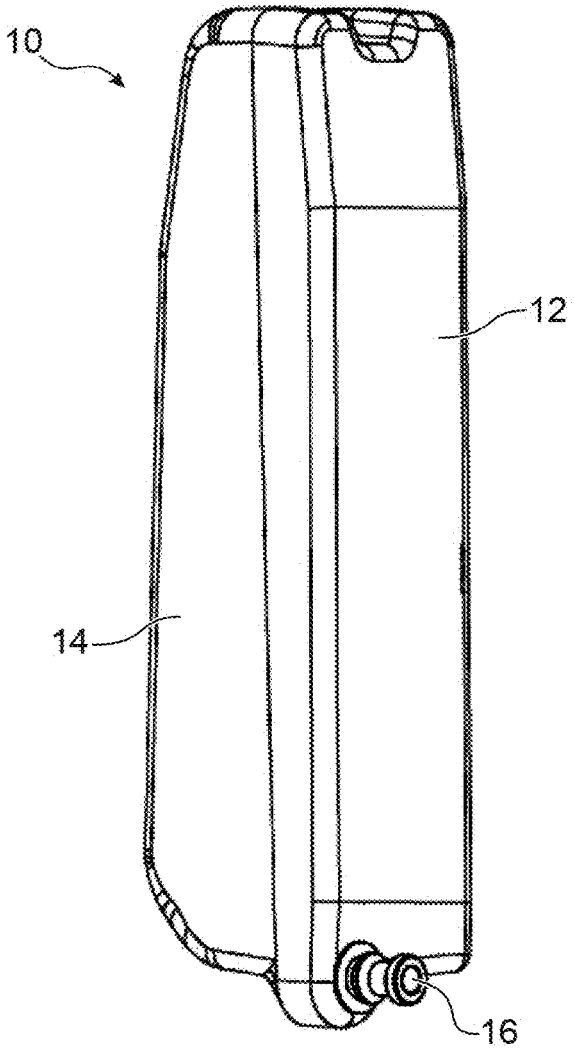
FIG. 2 represents an exemplary CIJ printer cartridge.
Figure 3A:
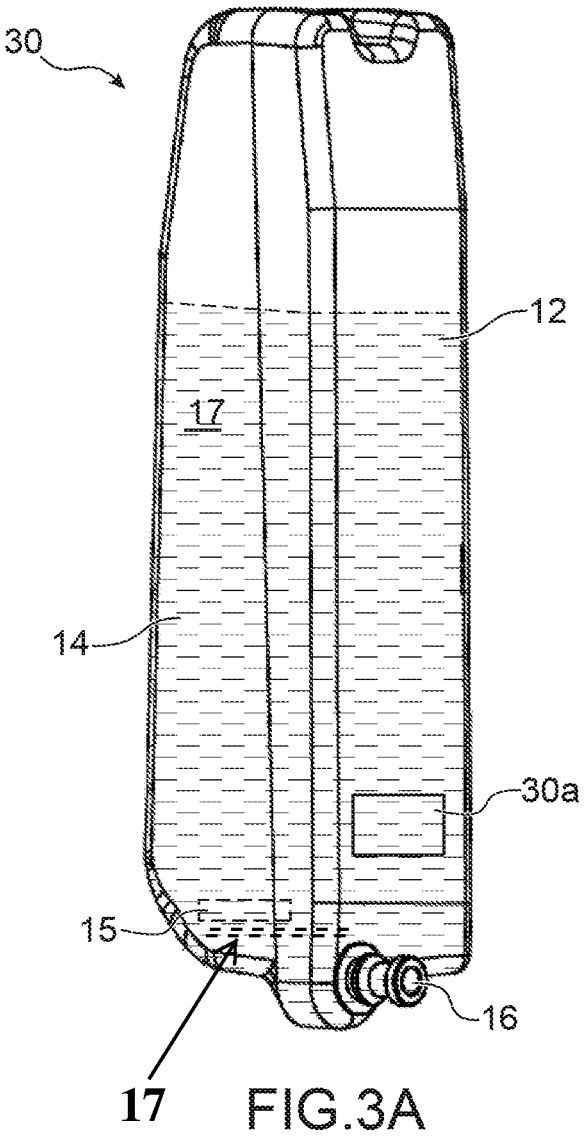
FIGS. 3A, 3B and 3C schematically represent a cartridge according to the invention and a magnetic bar for a cartridge according to the invention.

A cartridge 30 according to the invention is represented in FIG. 3A. On the outside, it has the same aspect as that described above in connection with FIG. 2.

This cartridge 30 has herein an elongate shape, and includes a rigid part 12 and a flexible or semi-rigid part or pocket 14. The cartridge is provided with an aperture, or mouth 16, which is the single aperture which enables the inside of the cartridge to be in communication with the outside (and thus the only way through which the ink contained in the cartridge will be flowable) and which is closed or hermetically sealed, with sealing means, before any use in a printer. The hermetic sealing means that no liquid can leak from the cartridge and no fluid (liquid or gas) can enter the same. The ink flows, towards the outside of the cartridge, through the aperture or mouth, when it is no longer hermetically sealed. Inside the cartridge, there is an ink flow port, which communicates with the output of the mouth or aperture. The mouth (term used in the following, but that can be also be understood as "aperture") is herein an extension of a rigid part. It is disposed in the same way when the cartridge is wholly a flexible or semi-rigid material.

Initially, the mouth can be closed by a capsule of a rubber type material, for example of EPDM, or else (chemically compatible with the fluids in question), being hermetically crimped. Upon placing the cartridge, the means 112 (FIG. 4A), for example a hollow needle, bonded to the ink circuit, enable the capsule to be removed (or struck or pierced or ruptured) and set the hydraulic circuit between the cartridge and the ink circuit. The elastic material of the capsule is chosen to ensure sealing of the needle-capsule junction.

Figure 3B:
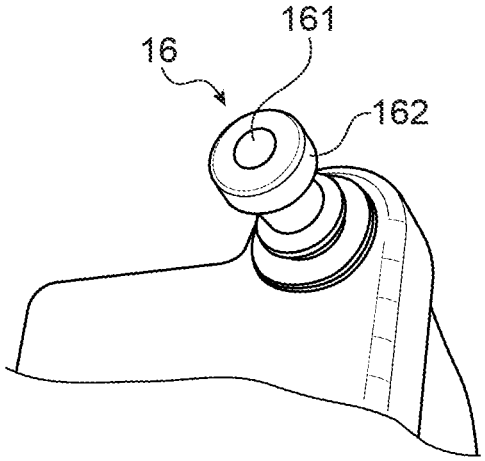

A more detailed view of the opening 16 is shown on FIG. 3B. Sealing means 161 are encapsulated in an encapsulating portion, for example a ring 162 which gives access to the sealing means. Said sealing means 161 are for example made of a material which has flexibility (or low hardness), for example rubber; such means comprise for example a rubber sealing. A rubber sealing 161 also enables several piercings, for example by a hollow needle, without any leakage: it is thereby ensured that the element which seals the cartridge is hermetically sealed, even if the cartridge, which still contains ink, is taken out of the ink circuit of a printer, for example to be installed on the ink circuit of another printer. When passing from one printer to the other, the cartridge does not lose ink and, preferably, air cannot enter therein. The flexibility (or low hardness) of the constitutive material of the membrane which seals the cartridge can ensure hermetic sealing during several connecting/disconnecting operations of the cartridge, despite the successive piercings of the membrane. Such a cartridge has for example a maximum inner volume of one litre or 900 $cm^3$, the maximum volume of the ink 17 present inside being between about 800 $cm^3$ and 600 $cm^3$.

The pigmented ink, as well as a magnetic element, which herein has the form of a small bar, designated by the reference 15 have been introduced therein. In practice, the magnet is introduced into the cartridge upon manufacturing the same, and then the cartridge is filled with ink. Finally, it is hermetically sealed.

The magnetic element can be chosen depending on its ability to generate, in a more or less full way, a vortex within the cartridge.

Figure 3C:
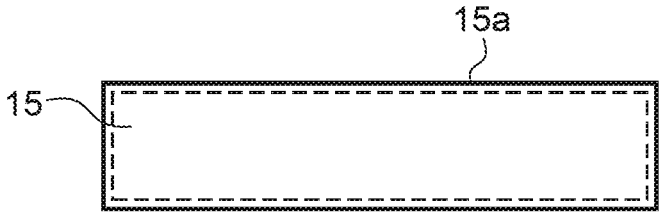

As illustrated in FIG. 3C, this magnetic element 15 (magnified in this figure) is preferably covered with a layer 15*a* of a protecting material in order to ensure the ink composition, otherwise the magnetic element is at risk to be oxidised by the ink solvent (which would alter the ink composition). A suitable material is Teflon.

For example, if the solvent is of the MEK (Methyl-Ethyl-Ketone) type, this is chemically aggressive and can oxidise the magnetic material.

In order for the magnetic means 15 not to risk to obstruct the ink flow port, the bar can be held at a given position in the cartridge by virtue, for example, of means such as a semi (or partially)-sealing or semi(or partially)-obturating or semi (or partially)-occluding element, disposed in the cartridge, which prevents the bar from becoming accommodated in the flow port without detriment to ink flow. Such an element 17 can include a separating grid, disposed so as to prevent the magnetic means 15 from reaching the ink flow port.

Various data, for example one or more physical and/or chemical data and/or one or more manufacturing and/or expiration date data relating to the ink contained in the cartridge, and in particular its composition and/or its viscosity can be stored in specific means associated with the ink cartridge used.

To that end, as illustrated in FIG. 3A, the cartridge 30 can be provided, preferably after sealing, with a circuit 30*a* (called a "tag" in the following), for example made as a processor or a microprocessor. This circuit 30*a*, which already contains one or more of the data above, is for example applied against a wall of the cartridge 30, on the side facing the printer when the cartridge is used in the same or even on the side where the mouth is located, above the same. This circuit enables one or more data as those mentioned above to be stored.

This circuit 30*a* can further include communication means, for example a RFID type interface, which will afford to talk with the controller 3 of the printer, for example to provide it with data which will be able to be interpreted as translating the presence of the cartridge and/or data related to the physical and/or chemical properties.

The controller 3 is, in turn, also provided with communication means 3*a*, for example a RFID type interface, which will afford to receive data transmitted by the cartridge tag.

Alternatively, the communication between the body 3 of the printer and the cartridge 30 can be of the contact type. In this case, contacts are provided, on the one hand on the cartridge, on the other hand on the printer, to ensure transmission of data between the cartridge 30 and the printer. Possibly, sending a RFD signal, from the tag to the controller, or reading, by the latter, the presence of the tag contacts, enables the presence of the cartridge to be detected. This check can be periodically made.

Tests show that the information in the tag and the operation thereof are not affected by the presence of the magnetic element 15. Tests have been made, the results of which show that neither the data nor the writing and/or reading functions of the TAG are disturbed by the magnetic element.

Figure 4A:
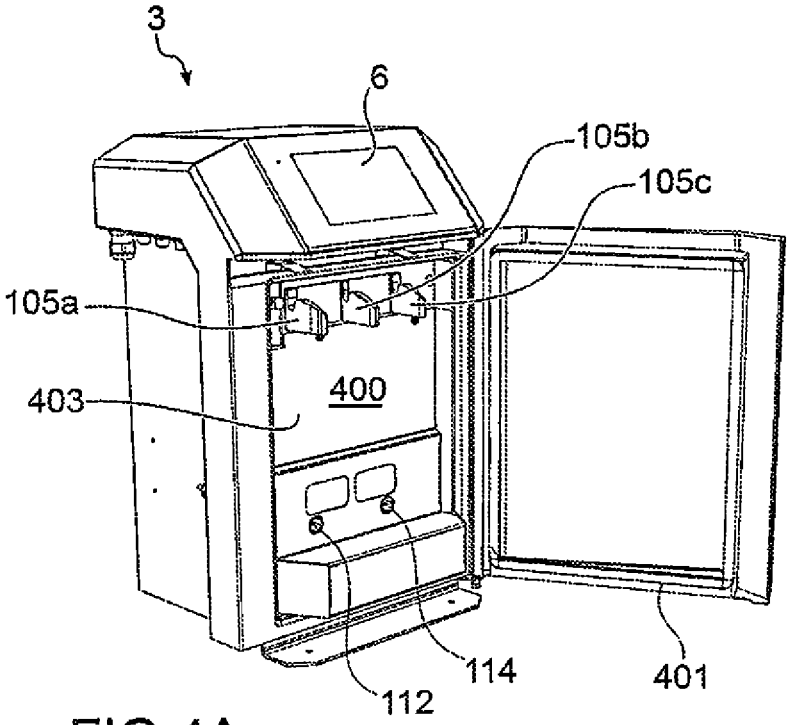
FIGS. 4A, 4B and 4D represent various aspects of a compartment for the cartridges of a CIJ type printer

A compartment 400 for ink 30 and solvent 40 cartridges of a CIJ type printer is schematically represented in FIG. 4A, on which the means 105*a*, 105*b*, 105*c* that will enable the cartridges to be positioned and held are distinguished. Reference 403 designates the bottom of the compartment. Means 112, 114 enable each cartridge to be connected to the fluid circuit of the printer. Each is for example as a cannula, which pierces the means for sealing the mouth 16. By, or after, removing or piercing or rupturing the sealing means, the fluid communication of the inside of the ink cartridge according to the invention is made with the printer ink feed circuit.

Figure 4B:
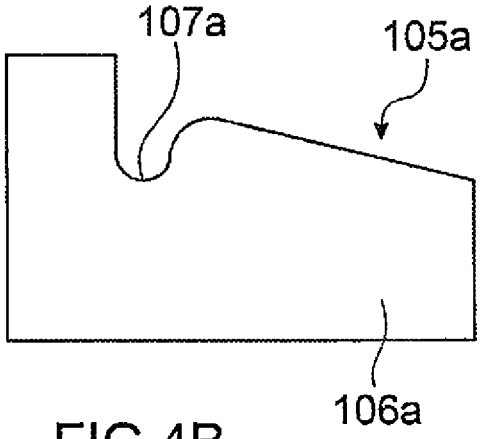

An exemplary embodiment of the means 105*a* (the means 105*b, c* being identical to 105*a*) is represented in FIG. 4B: they include a plate-shaped piece 106*a* (respectively 106*b, c*), having a substantially perpendicular shape and provided with the cut-out or notch 107*a* (respectively 107*b, c*).

Figure 4C:
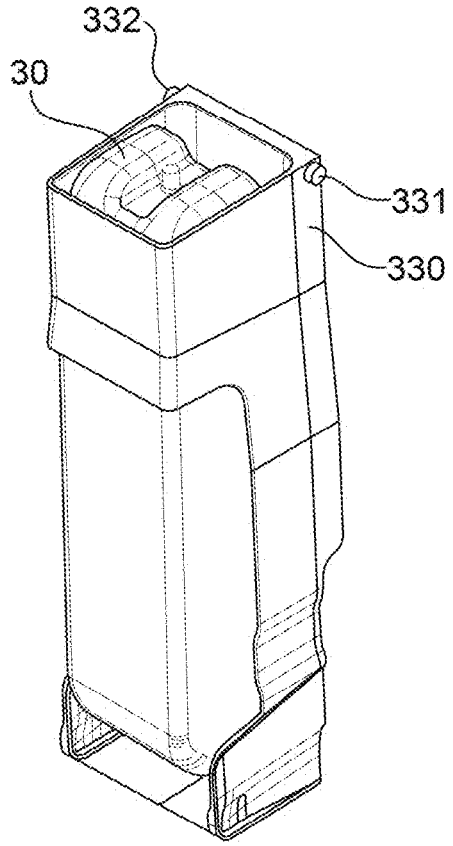
FIG. 4C represents a cartridge in its cartridge carrier.

As illustrated in FIG. 4C, the cartridge 30 is inserted in a box, or cartridge-carrier 330 provided with side pins 331, 332 in its upper part, each for being positioned in one of the notches 107*a-c*. A cartridge 40 is also intended to be inserted in its box 340 of the same type. The mouth 16 of each cartridge (not visible in FIG. 4C) is provided for being hydraulically connected to the ink (or solvent) circuit via the means 112, 114. The cartridge-carrier 330 is made in order to leave the mouth 16 and the optional tag 30*a* free.

Figure 4D:
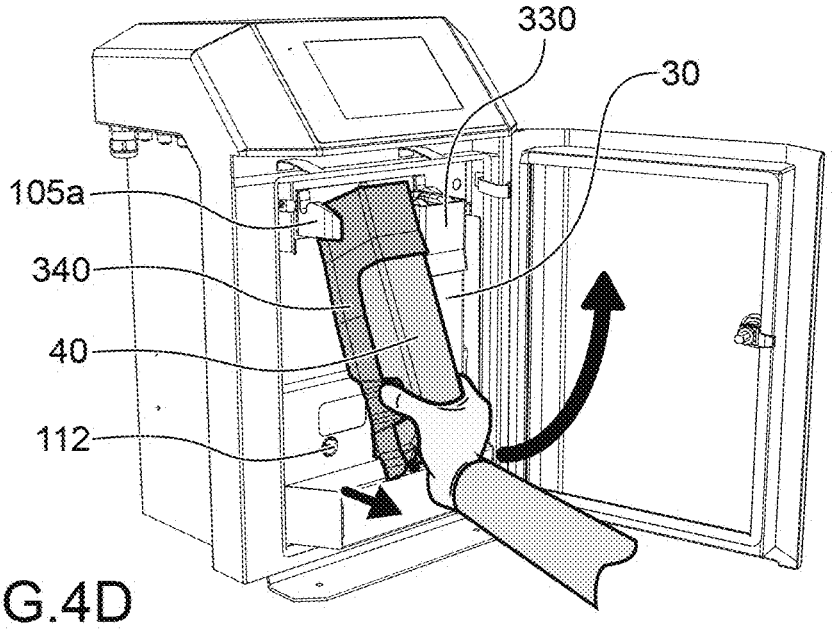

FIG. 4D represents 2 cartridges 30, 40, each in its box 330, 340, in the compartment 400, the cartridge 40 being currently installed. The means 105*a, b, c* are disposed such that 2 of them are disposed on either side of each box, the side pins 331, 332 of which are inserted and bear in the corresponding notches 107*a* (respectively b).

The mouth for hydraulically connecting each cartridge communicates with the ink (or solvent) circuit through the means 112, 114.

In order to implement a stirring of the fluid contained in the ink cartridge, using the magnetic element introduced therein, specific means are provided in this compartment 400. This means are described below.

Figure 5A:
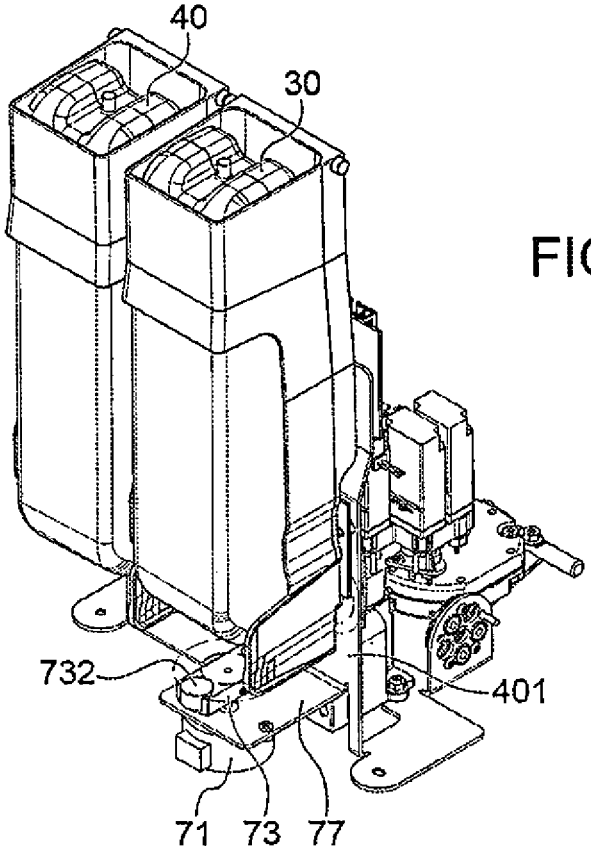
FIGS. 5A-5C represent different views of cartridges positioned in a CIJ type printer according to the invention.
Figure 5B:
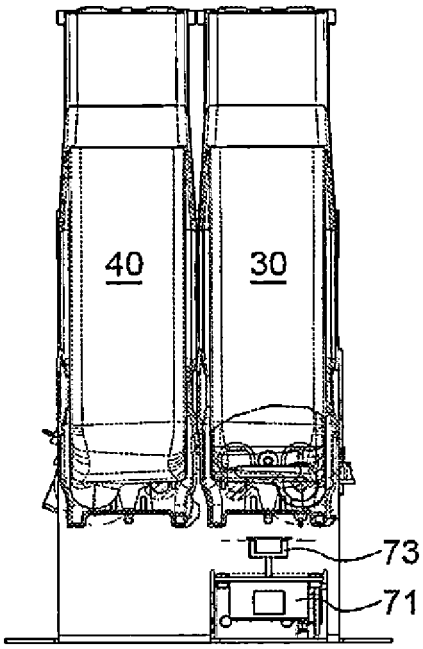
Figure 5C:
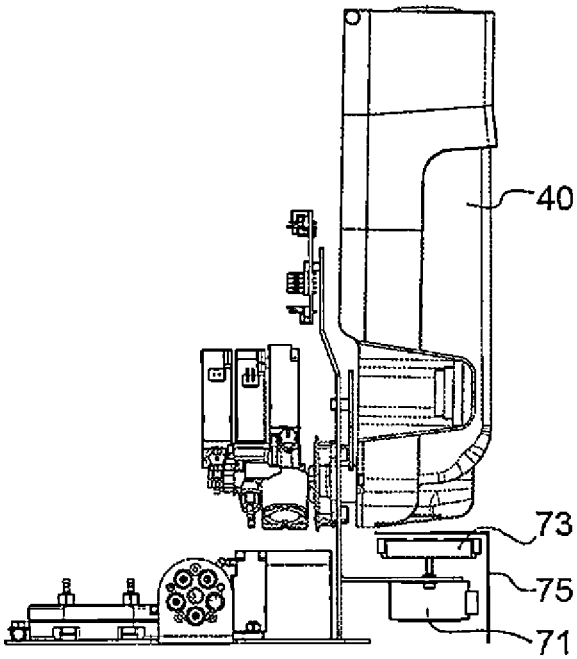

In FIGS. 5A-5C, two cartridges 30, 40, positioned in the compartment 400, and only a part of the inside of this compartment are represented.

The cartridge 30 is disposed in its accommodating volume, above an assembly including a motor 71 and a magnet support 73, this support being mounted to be rotatably driven by the motor. For example, a fixing screw enables the magnet support 73 to be fixed to the motor 71. Both these elements can be fixed on a plate 77, or on either side of the same. This plate is substantially perpendicular to the bottom 403 of the compartment.

Figure 6:
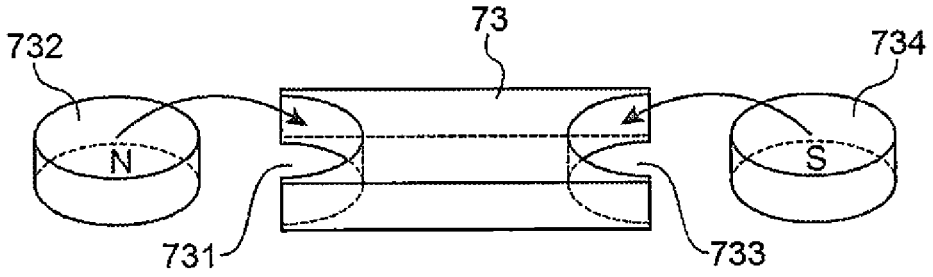
FIG. 6 represents a magnet support for a CIJ printer.

An exemplary embodiment of the support 73 is represented in FIG. 6.

It has an elongate shape and includes, at each end, a housing 731, 733 which enables a magnet 732, 734, to be received, one forming an N pole, the other an S pole. The interaction of these magnets, when rotated, with the magnetised bar 15 of a cartridge positioned in the compartment 400 will rotate the bar 15 in the ink, and thus will enable the cartridge ink to be agitated. A cap 75 (FIG. 5C) can protect the motor 71-support 73 assembly.

As is noticed in FIGS. 5A-5C, the motor 71 and the support 73, as well as the optional cap 75, can be disposed below the cartridge, without hampering the same nor any other element of the compartment 400, and in particular without hampering the closure of the door 401 of this compartment. In other words, agitating a cartridge according to the invention can be made by a compartment operating in a usual manner, the door 401 being closed.

The motor 71 can be a step motor, which enables the rotation speed to be well controlled.

According to one embodiment:

the support 73 enables 2 magnets, for example from ARELEC, Reference: 0016025 to be positioned; these are zinc coated neodymium-iron-boron magnets;

the magnetic bar 15 is from SODIPRO, Reference: 2 001 925; this is a smooth PTFE (Teflon) covered magnetic bar.

A model of pigmented ink cartridges of motor and magnets enable the rotation speed to be determined to ensure homogeneity of the ink with measurements of the viscosity as a function of time.

To that end, a magnetic stirrer was used and tests were made, under the following conditions:

blue pigmented ink, with a viscosity 4.5 cP;

ink cartridge of 600 $cm^3$, with an ink height $H_0$=17 cm;

magnetic bar 15 with a radius Rb=17 mm.

By an incrementation method, the rotation speed of the stirrer was increased until the limit for the appearance of a vortex at the ink surface was obtained.

This appears for an input speed of 650 rpm (that is 10.8 rps). By input speed, it is meant the minimum speed from which the full vortex is formed.

Using the following formulae, the motor torque C to be applied to drive the bar 15 as well as the radial speed Vr of a pigment at the edge of the cartridge (where the speed is lower than in the centre) can be calculated:

$$C=4*\pi*H_0*\eta*\omega*Rb^2,$$

$$Vr=\omega*Rb^2*Ln(R/Rb)/3(R-Rb),$$

where:

$H_0$ corresponds to the ink height in the cartridge (17 cm)

$\eta$ corresponds to the ink dynamic viscosity (4.5 cP that is $4.5*10^{-3}$ Pa·s)

$\omega=2\pi f$ is the angular speed of the bar (10.8 rp·$s^{-1}$)

Rb is the radius of the magnetic bar (17 mm)

R is the outer radius of the fluid volume, thus the "radius" of the cartridge (30 mm).

By applying both formula above, with the values defined above, this results in:

a driving torque of the bar of $3\times10^{-5}$ Nm;

a radially speed for a pigment at the edge of the cartridge of 0.046 m/s.

The motor 71 can thus be dimensioned in view of the invention.

Tests enable a minimum agitating speed to be determined for a given ink.

For example, 2 cartridges, each containing 600 $cm^3$ of a pigmented ink were agitated with 2 different motor rotation frequencies. The first cartridge is agitated at a frequency of 500 Hz, that is about 10 rps, the second at a frequency of 200 Hz, that is about 4 rps.

Visually, a change over time of the cartridge content can be noticed. For the first one, after 96 hr, a monophasic ink similar to the visual aspect of the starting ink is observed. For the second cartridge, the appearance of 2 phases in the cartridge was noticed early enough. On the upper part, a translucent phase appears revealing a migration of the pigments to the bottom of the cartridge by gravity. At the end of 96 hr, this translucent layer accounted for a height of about 1 cm.

A minimum frequency of 350 Hz or 400 Hz can thus be considered.

Tests made it possible to show that it is preferable to preserve a minimum ink volume in the cartridge such that the bar still keeps some efficiency. This volume can be of about 100 $cm^3$. More generally, a minimum volume could be defined as a function of the ink and the cartridge. Once this minimum volume is reached, the cartridge is preferably emptied at a time. Indeed, once this minimum value is reached, the agitation is no longer efficient because the flexible part 14 of the cartridge is depressurised and is somewhat "deformed", such that the means 15 cannot be efficient any longer. This can be visually noticed. In use, the remaining volume in the cartridge can be calculated by the controller of the printer (it is the volume initially contained in the cartridge (which can be stored in the tag) minus the volume already pumped). When the threshold volume is reached, the controller makes the decision to pump the remaining ink of the cartridge to empty the same.

Different tests were made, which confirm the interest of an agitation using a magnetic bar introduced in the cartridge and driven by a magnetic motor.

First, a test was made, consisting in continuously agitating an ink cartridge of 600 $cm^3$, for 30 days: this test aimed at validating whether a continuous agitation of the cartridge would enable to preserve a homogeneous and a quality ink for such a duration.

The operation frequency was 500 Hz.

Regular samplings, at 3 days interval, were made, and L, a, b, Rc. L were measured, a and b are the parameters of the CIE Lab colorimetric system, L being brightness, a being representative of the hue, b being the saturation (2 combined parameters) and Rc the contrast ratio. ES represents the dry solids content.

A reference, the viscosity and optical density of which are between the indicated values, are referred to in the first row of the table. This reference is used to check whether the values are constant overtime, but there is no tolerance for deviation with respect to reference values. Results are listed in table I below.

TABLE I

| | Viscosity at 20° C. | Optical density at 512 nm | | L, a, b and Rc measurements on a penetration chart (HC2) | | | |
|---|---|---|---|---|---|---|---|
| Sampling | (cPs) | (1/200 in MEK) | ES (%) | L | a | b | R c |
| Reference | 4.2.< <5.2 | 0.87< <0.98 | 27.2 | | | | |
| P1 | 4.84 | 0.894 | 27.3 | 58.6 | −2.72 | −8.31 | 0.615 |
| P2 | 4.92 | 0.902 | 28.1 | 59.4 | −2.74 | −8.22 | 0.625 |
| P3 | 5.00 | 0.899 | 27.7 | 58.8 | −2.74 | −8.28 | 0.618 |
| P4 | 4.96 | 0.896 | 27.8 | 59.5 | −2.77 | −8.16 | 0.625 |

Thus a homogeneity of the ink characteristics by virtue of the agitation of the cartridge is noticed over time. The results are satisfactory, and each ink sampling showed ink physical characteristics close to the nominal characteristics.

The agitation behaviour on cartridges left standing for a long time was also tested. Ink cartridges were thus aged for 7 days, and then installed in a machine and agitated to determine the time for obtaining a homogeneous ink. The results show that at the end of 5 minutes, the ink has recovered homogeneity and physical characteristics close to the nominal characteristics.

Thus, an experience in which 9 cartridges were placed in sedimentation, for 7 days, mouth outwardly directed, under the conditions of a cartridge positioned in a CIJ printer was made. 9 other cartridges have been placed under the same conditions for 30 days.

These 2 batches were then subjected to an agitation according to 9 different configurations (1 min, 3 min, 5 min and 10 min at speeds of Vvortex, Vvortex−25% and Vvortex+25%).

Samplings on the "7 day" batch were made and the results are pooled in table II below, wherein ES, L, a and b have the same meaning as above. The first row corresponds to a reference ink (see the explanations already given above as regards the reference use), some data of which are indicated.

There are 2 columns "wavelength at max peak": the first of these columns corresponds to the wavelength at which the maximum absorption peak (the value of which is in the next column "Abs. at max peak")) is obtained with the samplings. The second column indicates a wavelength (512 nm) at which the absorbance is measured for 1/10000 dilution (see in next column).

With the reference ink, a full optical density scan absorbance) made in the visible domain and it was observed where appears the maximum peak; the same protocol was used with the inks sampled.

A cartridge according to the invention is made by forming a shell including a rigid part 12 and a flexible or semi-rigid part, or pocket 14. Upon forming the shell, the possible means for preventing the magnetic means for becoming accommodated in the flow port and the magnetic means 15 are introduced therein.

The filling of the cartridge is then made using the ink, containing pigments, and the cartridge is hermetically sealed. A tag 30*a* (FIG. 3A) can be applied against the external surface of the cartridge. The datum or data mentioned above were introduced in the tag before it was applied against the cartridge.

The cartridge remains under this state until it is installed in or on a printer, in particular a CIJ type industrial printer, where, for example, its aperture (here: a mouth) 16 is pierced or connected to the ink circuit in order to send the ink from the cartridge to a printing head. Data written in a tag 30*a* can be read by the controller of the printer.

A cartridge according to the invention can for example be used in a printer, for example a CIJ type industrial printer; an exemplary ink circuit in which it can be incorporated is that described in EP0968831. Another example is given below.

Agitating the ink contained in the cartridge is advantageously made under the following conditions:

- after a shutdown of the machine, for example if the user decided to completely disconnect power or after a shutdown which results from the full absence of current power, for example after a mains breakdown, an agitation is conducted upon restarting the machine;
- during a shutdown of the machine, but with a current power available; in this case, the ink can be agitated during the shutdown, preferably regularly, using the magnetic means;
- upon using the machine, during printing, the ink can be agitated, preferably regularly, using the magnetic means.

TABLE 2

| | Protocol | | | | Optical density (1/10 000 dilution in MEK) | | | | | | | | |
|---|---|---|---|---|---|---|---|---|---|---|---|---|---|
| | | | | | Wave-length | | Wave-length | Absorbance at | | Auto. HC2 HC flattening on penetration chart (speed 5) | | | |
| Sampling from cartridge | Sedimen-tation time (J) | Agitation frequency (Hz) | Agitation duration (min) | Viscosity at 20° C. (cPs) | at max peak (nm) | Abs. at max peak | at max peak (nm) | wavelength given for 1/10 000 dilution | ES % | L | a | b | Rc |
| 9281-ref | / | / | / | 4.2< <5.2 | / | / | 512 | 0.714< <0.196 | 27.2 | / | / | / | >0.65 |
| Sed-1 | 7 | 300 | 1 | 6.12 | 584 | 0.489 | 512 | 0.46341 | 44.5 | 72.7 | −2.27 | −7.94 | 0.765 |
| Sed-2 | 7 | 300 | 3 | 5.78 | 584 | 0.431 | | 0.41341 | 39.8 | 72.2 | −2.27 | −7.57 | 0.759 |
| Sed-3 | 7 | 300 | 5 | 4.91 | 555 | 0.210 | | 0.20596 | 29.5 | 66.8 | −2.63 | −7.18 | 0.702 |
| Sed-4 | 7 | 300 | 10 | 4.84 | 552 | 0.204 | | 0.2004 | 29.2 | 63.8 | −2.62 | −7.43 | 0.670 |
| Sed-5 | 7 | 225 | 1 | 7.20 | 588 | 0.564 | 512 | 0.53407 | 48.7 | 72.8 | −2.26 | −7.78 | 0.768 |
| Sed-6 | 7 | 225 | 3 | 5.20 | 564 | 0.309 | | 0.30062 | 34.7 | 69.1 | −2.39 | −7.44 | 0.727 |
| Sed-7 | 7 | 225 | 5 | 4.92 | 552 | 0.225 | | 0.22122 | 30.0 | 65.4 | −2.57 | −7.33 | 0.686 |
| Sed-8 | 7 | 225 | 10 | 4.93 | 546 | 0.216 | | 0.21306 | 29.7 | 64.9 | −2.54 | −7.29 | 0.681 |

Figure 7A:
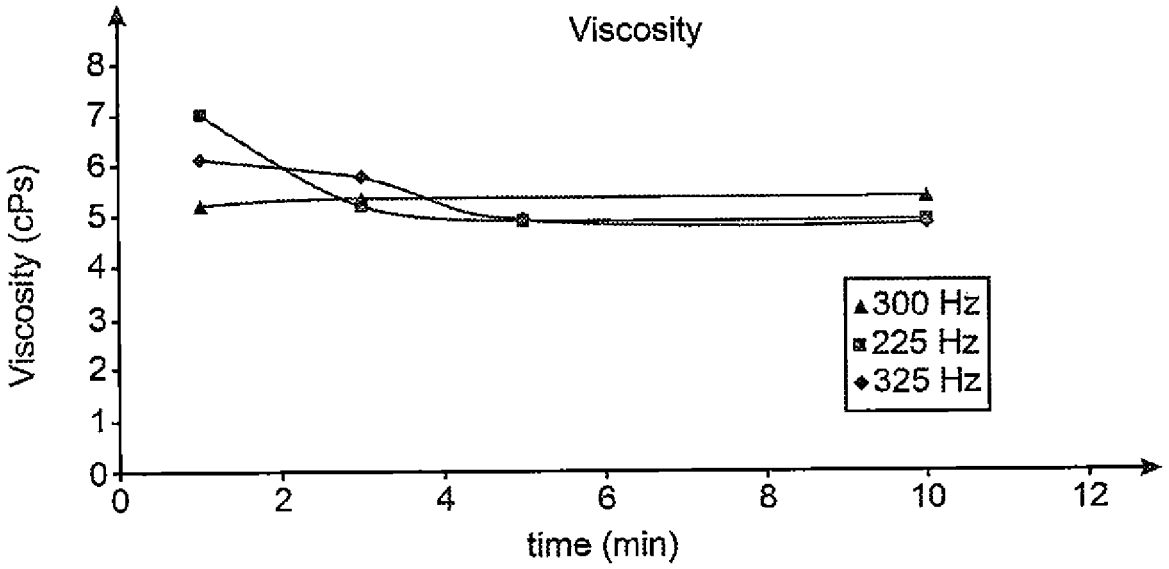
FIGS. 7A and 7B represent test results with cartridges according to the invention.
Figure 7B:
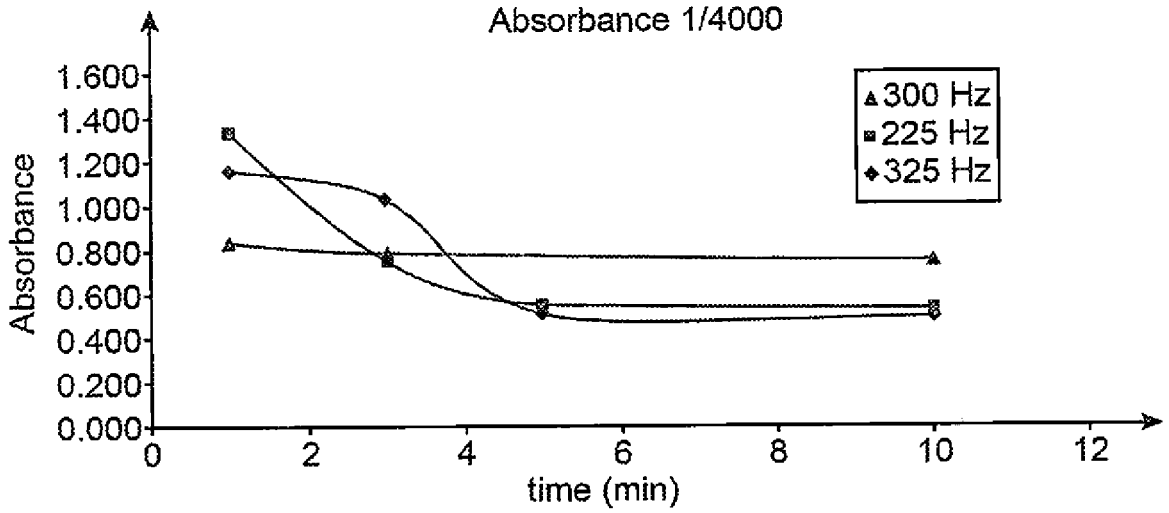

In FIGS. 7A and 7B, the change in viscosity and absorbance is represented as a function of the agitation time.

Based on these measurements, it is noticed that the ageing of the cartridges causes a deterioration in their characteristics.

It is noticed, for tests at 225 Hz and 300 Hz, that from 5 minutes of agitation, the viscosity and absorbance values tend to a plateau. As regards absorbance, this plateau remains higher than the nominal value.

According to an exemplary use, the agitation in a cartridge is activated for 10 min upon powering or starting the machine, and then by a 10 min cycle. More generally, an activation can be made for a duration between 5 minutes and 30 min, and then an interruption for a duration between 5 minutes and 30 min. The rotation frequency of the bar is of 600 Hz.

Generally, the agitation operations can be controlled by the controller or control means) 3 of the entire printer.

The instructions, for activating the means 71, 73, 15, are sent and controlled by these means 3.

The control means 3 include for example a processor or a microprocessor, programmed to implement an agitation method in accordance with the invention. It also ensures storing data, for example ink consumption measurement data from the cartridge, and their possible processing. The controller is also programmed to manage operations other than those of agitation, in particular printing operations. It also enables ink transfer operations to be controlled, from the cartridge to the printer ink feed circuit.

A circuit of a CIJ type printer in which a cartridge according to the invention can be used will now be described.

Figure 1:
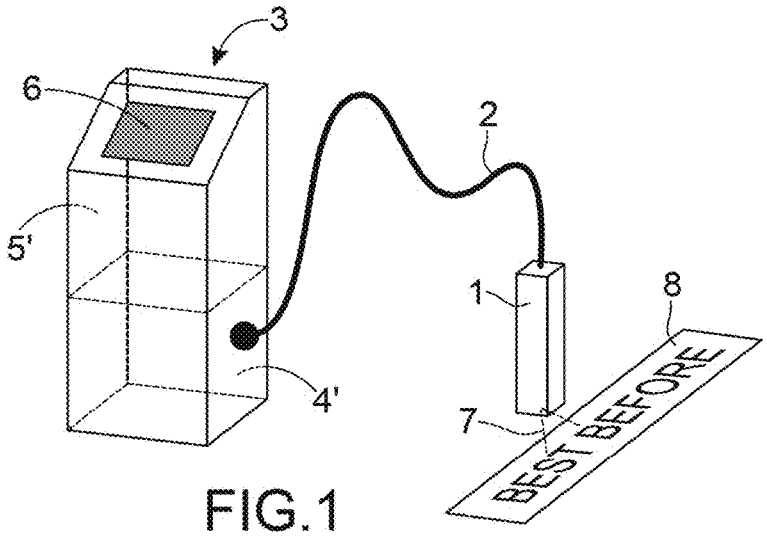
FIG. 1 represents a known structure of CIJ type printer.

An example or a general structure of a printer to which the invention can be applied is shown in FIG. 1, comprising a print head 1, which can be offset from the body of the printer 3 and connected to it through a flexible umbilical 19 containing hydraulic and electrical connections for operating the head, while providing it with flexibility to facilitate integration on the production line.

The body of the printer 3 (also called the console or cabinet) may contain three subassemblies:

- an ink circuit, for example located in the lower part of the console (zone 4'), that firstly supplies an appropriate quality of ink to the head at a stable pressure, and secondly handles ink output from jets that is not used for printing;
- a controller, for example located in the top of the console (zone 5'), capable of managing sequences of actions and performing processing to activate different functions of the ink circuit and the head;
- an interface 6 that provides the operator with the means of using the printer and remaining informed about its operation.

It may also contain a compartment 400 for ink 30 and solvent 40 cartridges as disclosed above, for example comprising the motor 71 and the support 73, as well as the optional cap 75, also disclosed above.

Normally, the ink circuit comprises a reservoir called the main reservoir into which ink and solvent mix is brought. The ink and solvent originate from an ink cartridge, which can be a cartridge according to the invention (as disclosed in this specification), and a solvent cartridge respectively. The main reservoir supplies the print head.

Figure 8:
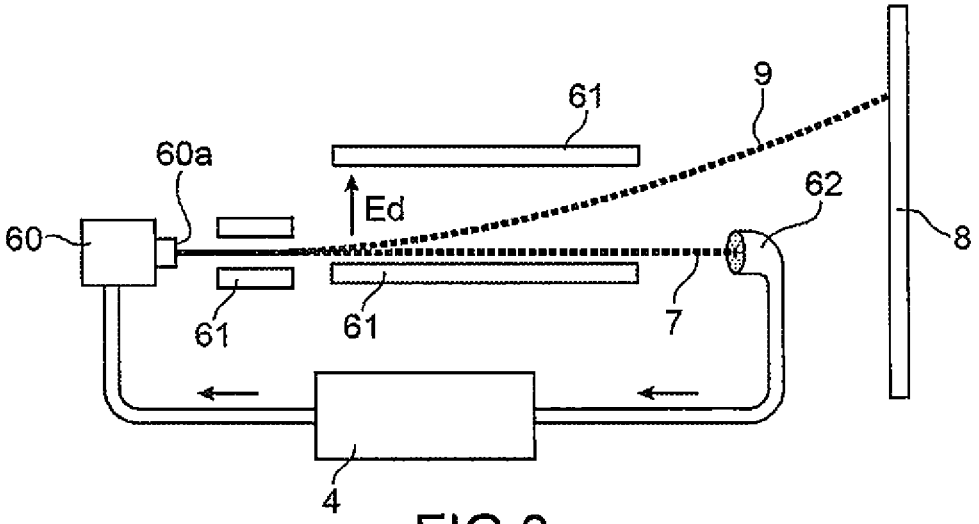
FIG. 8 shows a known structure of a print head of a CIJ type printer.

FIG. 8 diagrammatically shows a print head 1 of a CIJ printer which can be used in connection with the structure of FIG. 1. It comprises a drop generator 60 supplied with electrically conducting ink pressurised by the ink circuit (in zone 4'). In an inkjet printer, means (or ink pressurisation circuit) are provided to draw off ink from the main reservoir, and to send it to the print head.

In particular, these means comprise a pump that pumps ink from the main reservoir, that may then be directed towards the print head; this ink may possibly or alternately be directed to the ink cartridge itself, or to the main reservoir itself, instead of being sent to the print head.

Figure 9:
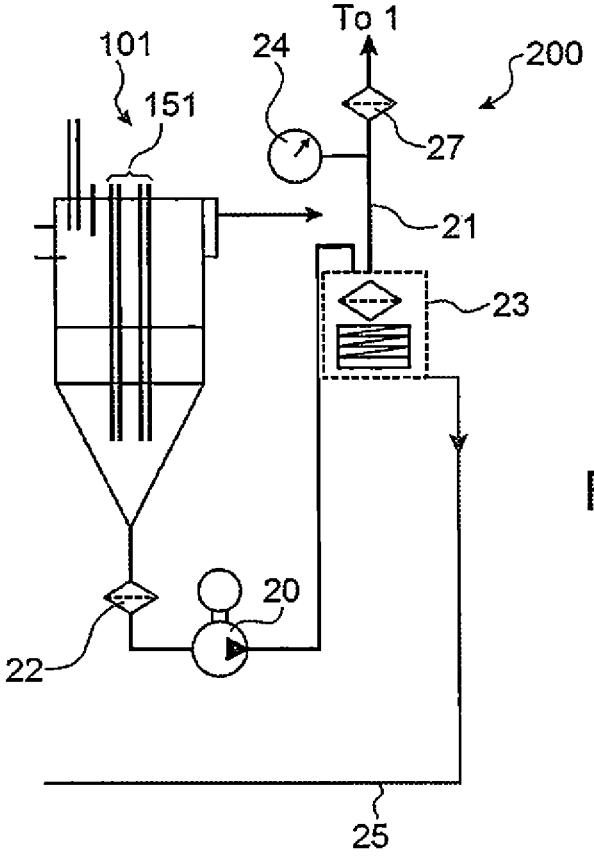
FIG. 9 is an example of a fluid circuit for pressurising ink.

According to one embodiment shown in FIG. 9, such means 200, to draw off ink from the main reservoir, at the outlet from the main reservoir 101 comprise a filter 22, a pump 20 (called the ink pressurisation pump) and an anti-pulse device 23. The pump 20 will provide a constant jet velocity at the outlet from the print head nozzle, for example by forming part of the slaving means, comprising a sensor for measuring the jet velocity in the head, for example a sensor like that disclosed in application PCT/EP2010/060942.

Ink may be sent to the print head 1 through a conduit 21 connected downstream from the anti-pulse device 23. The print head may itself comprise a valve that enables or disables production of an ink jet and possibly a printout.

As a variant, ink may be sent through a conduit 25 (and a valve not shown in FIG. 9), either to the main reservoir itself or to the ink cartridge itself (as far as inside the ink cartridge). The ink path at the outlet from the pump 20 can be controlled using one or several valves, preferably a 3-way valves.

A pressure sensor 24 and possibly a temperature sensor is arranged as shown in FIG. 9, downstream from the anti-pulse device 23 and preferably at the outlet from the anti-pulse device and upstream from filter 27. Sensor 24 can be used to measure the ink pressure (or variations in this pressure) in the circuit. The data provided by this sensor can be used by the controller, particularly to slave the ink viscosity.

The position of a sensor 24 at the outlet from the device 23 compensates for pressure losses due to the device 23 and the remainder of the ink circuit that are difficult to model; thus, the measured pressure gives a good representation of the pressure at the nozzle.

This position of the sensor 24 can result in additional pressure losses that are low compared with the pressure at the nozzle and that are therefore taken into account in self-calibration. On the other hand, another position of the sensor at another point in the circuit would make the approach more complex.

But this position downstream from or at the outlet from device 23 can also provide information about the pressure in the remainder of the circuit and particularly in means 300 (see FIG. 10) that, as already explained above, can supply the main reservoir 101 with ink from the cartridge 30, Pressure information will be useful during other operating phases of the machine (for example shutdown phase and/or maintenance phase and/or self-diagnostic phase, during startup or shutdown), Therefore, the sensor 24 can give information during different phases of the machine, firstly when it is required to adjust the viscosity, and secondly during these other phases. For information, during these other phases, the position of the sensor 24 at the outlet from the device 23 is not optimum because the device 23 has a retarding effect on the ink, in other words the value measured by this sensor is not the value of the ink actually present at this instant in the remainder of the fluid circuit, upstream from the device 23. But this position makes it possible to use a single sensor for the 2 types of information.

All the means disclosed above with reference to FIG. 9, and particularly the pump 20 and the solenoid valve(s) used in combination with the means 200, are controlled by the controller 3 especially programmed for this purpose.

Figure 10:
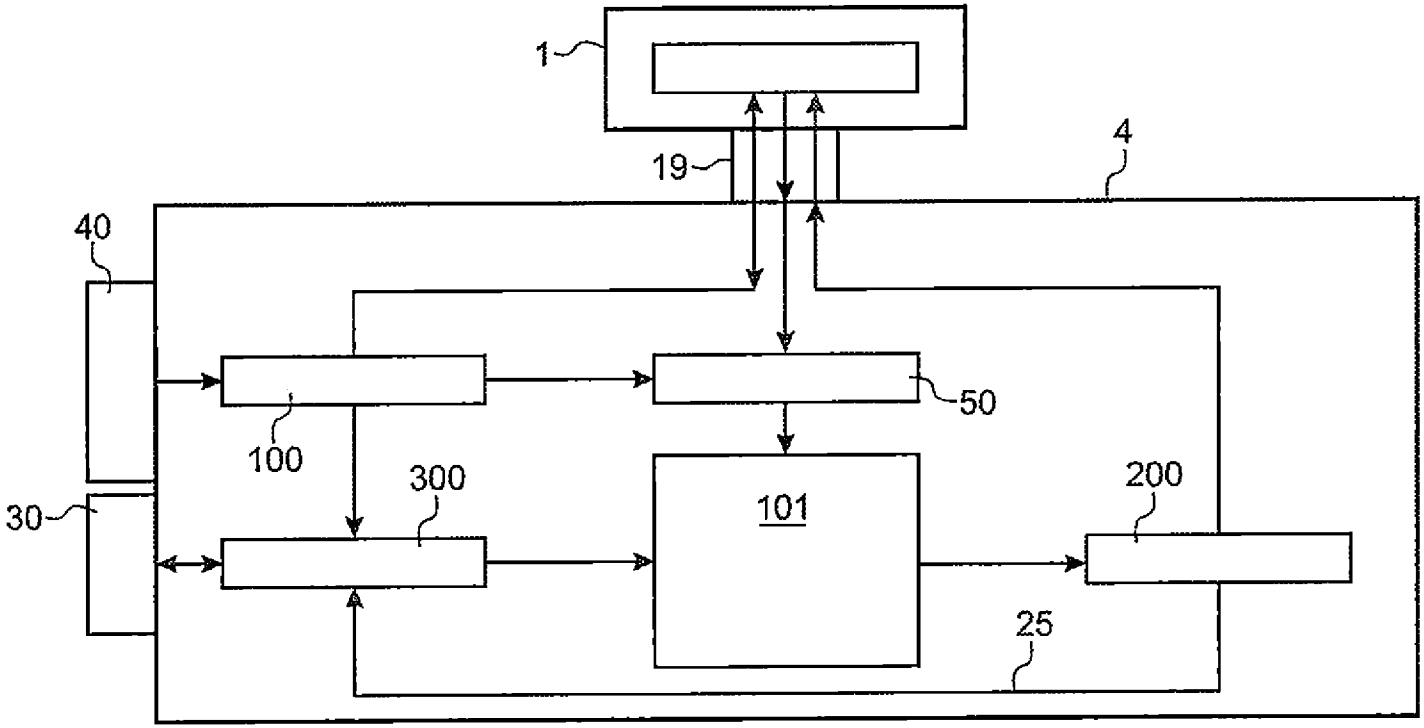
FIG. 10 shows an example of a fluid circuit where a cartridge according to this invention can be implemented.

An example of an architecture of the fluid circuit of a printer to which the invention can be applied is shown in FIG. 10 on which references identical to those used previously denote identical or corresponding elements. In particular, the flexible umbilical 19 is shown that contains hydraulic and electrical connections and the print head 1, to which the printer architecture disclosed below can be connected.

FIG. 10 shows that the fluid circuit 4 of the printer comprises a plurality of means 101, 50, 100, 200, 300, each means being associated with a specific function. A removable ink cartridge 30, preferably according to the invention, and a solvent cartridge 40 that is also removable are associated with this circuit 4. Although the presence of cartridges can be recommended, including when the ink circuit is stopped (for example to enable active monitoring), the ink circuit may be without the cartridges 30, 40 when stopped or at rest.

Reference 101 refers to the main reservoir that contains a mix of solvent and ink.

Reference 100 (or solvent supply circuit) refers to all means that are used to draw off and possibly store solvent from a solvent cartridge 40 and to supply solvent thus drawn off to other parts of the printer, either to supply the main reservoir 101 with solvent, or to clean or maintain one or several of the other parts of the machine.

Reference 200 denotes all means used to draw off ink from the main reservoir 101, an example of these means has been disclosed above with reference to FIG. 9. These means 200 (or ink pressurization circuit) are for pressurising ink drawn off from the main reservoir and for sending it to print head 1. According to one embodiment illustrated here by arrow 25, it is also possible that these means 200 can be used to send ink to the means 300, and then once again to the reservoir 101, which enables ink flow recirculation inside the circuit. This circuit 200 may also allow draining the reservoir in the cartridge 30 and/or cleaning of the connections of the cartridge 30 (in the case of the embodiment in FIG. 14, by changing the position of the valve 37).

Reference 300 (or ink supply circuit) refers to all means of drawing off ink from an ink cartridge 30 and supplying the ink thus drawn off to supply the main reservoir 101. As can be seen on this figure, according to the embodiment disclosed herein, these means 300 can be used to send solvent from means 100 to the main reservoir 101.

The system shown on this figure also comprises means 50 of recovering fluids (ink and/or solvent) that returns from the print head, more precisely from the gutter 62 of the print head or from the head rinsing circuit. Therefore these means 50 are arranged on the downstream side of the umbilical 19 (relative to the flow direction of fluids returning from the print head).

As can be seen on FIG. 10, the means 100 may also allow sending solvent directly to these means 50 without passing through the umbilical 19 or the print head 1 or the recovery gutter 62.

Preferably, the means 100 comprise at least three parallel solvent supplies, one to the head 1, the $2^{nd}$ to means 50 and the $3^{rd}$ to means 300.

Each of the means described above can be provided with means such as valves, preferably solenoid valves, for guiding the fluid concerned to the chosen destination. Thus, means 100 can be used to send solvent exclusively to head 1, or exclusively to means 50 or exclusively to means 300 (and in particular, through these means 300, to the main reservoir 10).

Therefore, the means 100 are used to do partial rinsing (that enables a saving of fluid (solvent) and time, but also to not prevent other parts of the printer from performing some tasks); or complete rinsing of the entire circuit can be done by sending solvent to all means forming part of the ink circuit. These means 100 can also possibly send solvent exclusively to the main reservoir 101, particularly in the case in which such addition of solvent is considered necessary after the detection of a viscosity variation.

Each of the means 50, 100, 200, 300 described above can be provided with a pump that is used to process the fluid concerned (the $1^{st}$ pump, $2^{nd}$ pump, $3^{rd}$ pump, $4^{th}$ pump respectively). These various pumps perform different functions (the functions of their corresponding means) and are therefore different from each other, although these different pumps may be of the same type or a similar type (in other words, none of these pumps performs 2 of these functions).

Figure 11:
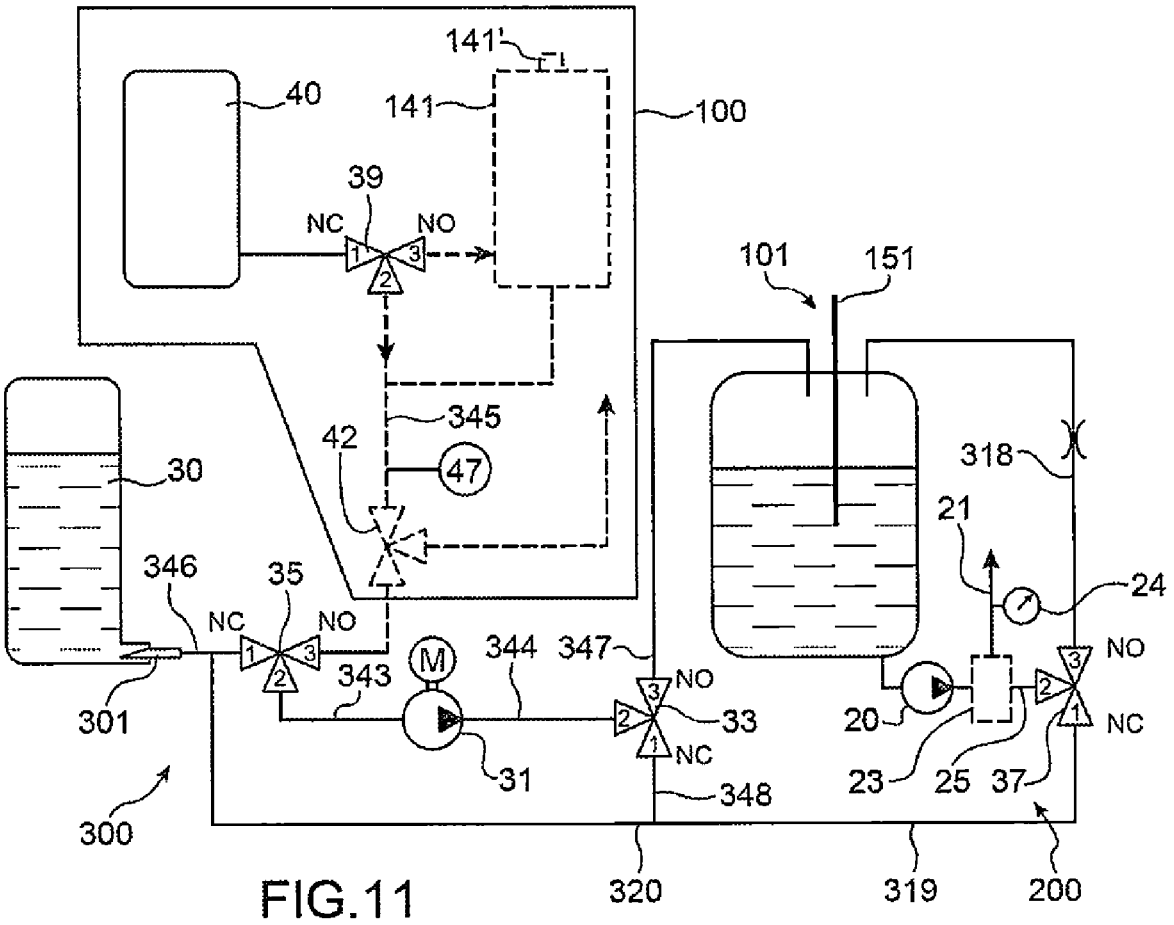
FIG. 11 is an example of an ink circuit, a main reservoir and a pressurisation circuit where a cartridge according to the invention can be implemented.

FIG. 11 shows a more detailed representation of means 300, in cooperation with the main reservoir 101 and the means 200.

The main reservoir 101 is preferably provided with means 151 for detecting the level of ink contained in it (in fact the ink in it is mixed with the solvent).

Reference 301 refers to the cannula (or any equivalent means), that will provide fluid connection between the cartridge 30 and the rest of the circuit.

When the cartridge 30 is in position and contains ink, ink may be pumped by pumping means 31 ($4^{th}$ pump) towards the main reservoir 10 through fluid connection means, comprising conduits 346, 343, 344, 347 and one or more valve(s) (or solenoid valves) 33, 35, that may be 3-way type valves. Thus, the ink transfer pump 31 pumps ink from the cartridge 30, and the ink passes in sequence through valves 35 and 33 (in positions «12», or "NC", and «23», or "NO" respectively in FIG. 11), and through conduits 343, 344, 347 to reach the main reservoir 10. The NO (respectively NC) state of the valve 35 corresponds to the position «23» (respectively «12») creating connections between conduits 345 and 343 (respectively 346 and 343).

Means 345, 35, for example a conduit and a valve respectively (when the valve is in position «32» (NO) in FIG. 11) at the inlet to means 300, can be used to receive solvent from means 100. The means 300 will then increase the pressure of this solvent to a relative pressure («gauge pressure») equal for example to between 0 and 5 bars or between 0 and 10 bars, in fluid connection means.

This solvent may be directed through the conduits 343, 344 depending on the open or closed state of the valves 35 and 33:

- to reservoir 101 (through the conduit 347, valve 35 in position «32» (NO), valve 33 in position «23» (NO)), to add solvent into the reservoir 10;
- to conduits 320 (through the conduit 348, valve 35 in position «32» (NO), valve 33 in position «21» (NC)). Since the valve 37 is in the NO position, solvent can then be directed to the cartridge 30 through conduits 344, 348 and 320.

Ink pumped by pump 20 of means 200, at the outlet from the main reservoir 101, can be directed either towards the main reservoir itself (through the return conduit 318) or towards the cartridge 30 itself (and into this cartridge) through one or several conduits 319, 320, The ink path at the outlet from the pump 20 may be controlled by means of one or several valves 37, preferably a 3-way valve. In FIG. 11, the position «21» («NC») of valve 37 directs the ink flow towards the conduit 319, and position «23» («NO») directs the ink flow towards the conduit 318. Ink is transferred to the print head 1 through a conduit 21 that collects ink downstream from the pump 20, preferably from means 23 located between the outlet from the pump 20 and the valve 37.

FIG. 11 also diagrammatically shows means 100 for supplying solvent from a removable cartridge 40 and possibly from an intermediate reservoir 14. The solvent may be drawn off using a pump not shown on this figure, from one or another of these reservoirs through a valve 39 and sent through the conduit 345 and possibly a valve 42, towards the valve 35 and means 300.

Generally, the instructions to activate pumps and valves are sent and controlled by the control means 3 (also called "controller"). In particular, these instructions will control flow of solvent, that can be under pressure, from means 100 to various other means 1, and/or 50, and/or 300 of the circuit (and possibly through these latter means 300 to the main reservoir 101).

The control means 3 may comprise a processor or microprocessor, programmed for example to implement a cleaning of part of the circuit. These means may control the opening and the closing of each valve, as well as the activation of the pumping means, in order to circulate ink and/or solvent. In one or more memory or memory means, it also memorises data, for example pressure measurements data (in particular from sensor 24) and/or ink and/or solvent level measurement data, and may also possibly process these data. Such control means may be programmed to implement a method, in particular an agitation method, according to the invention. It may make the decision, or be programmed to make such decision, to pump the remaining ink of a cartridge to empty it, as already disclosed above. The controller may also be programmed to manage other operations, particularly printing operations. It may also store in said memory or memory means data related to the optimum viscosity of an ink or to a variation of this viscosity as a function of temperature.

For safety reasons, the controller may make sure that the cartridge is still in position before any fluid, in particular solvent, is transferred to the cartridge 30, for example during cleaning operations. No operation will take place if no cartridge is in position. This can be done using data exchanged between the cartridge 30 provided with a circuit 30*a* («tag»), and the printer controller 3, particularly one or more data that can be interpreted as demonstrating the presence of the cartridge.

The controller 3 may also check the non-empty state of the cartridge 30 for example, before starting some or any cleaning operation, for example of the cannula 301. The empty state of the cartridge 30 may be detected particularly by variations in the ink level in the main reservoir 101 measured using means 15 and the controller 3. For example, this is the case if the variation of the ink level is less than a threshold value (for example 5/10 mm) for a predetermined duration (for example 20 s), when the pump 31 is in operation to inject ink to the main reservoir 101. On the other hand, if the variation in the ink level during said predetermined duration is more than the threshold value, the cartridge 30 is not empty. If a cartridge is in position but is empty, the cleaning operations will not take place.

Figure 12:
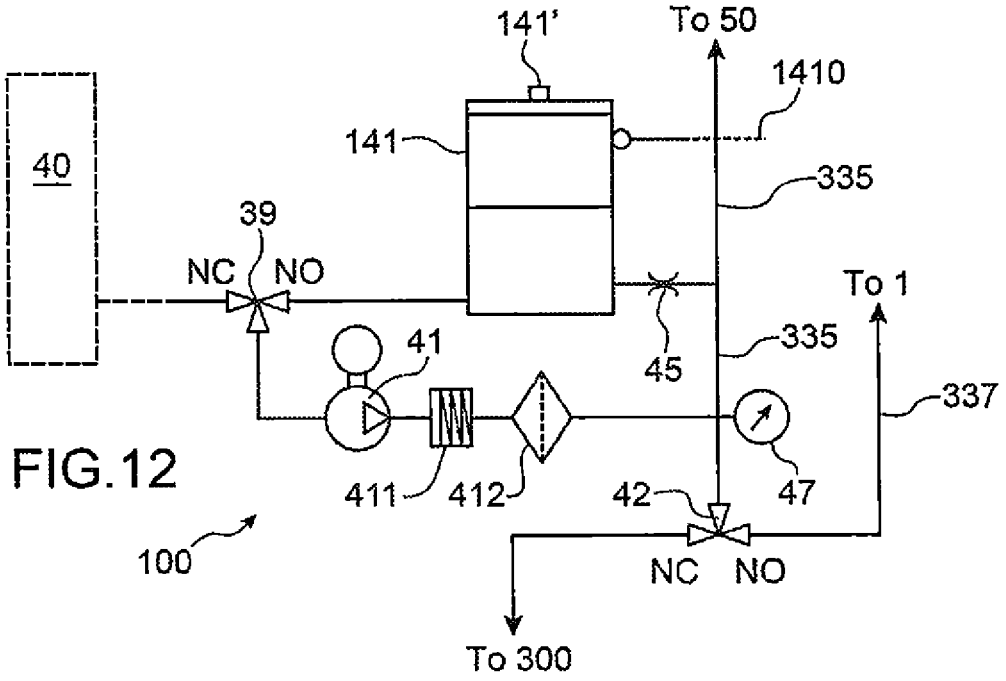
FIG. 12 is an example of a circuit for injecting solvent.

FIG. 12 shows an even more detailed representation of means 100 that draw off solvent from a cartridge 40 and send it to the different parts of the device, for example to perform cleaning or unblocking operations, or to supply solvent to the main reservoir 101.

These means comprise a pump 41 (the $2^{nd}$ pump) and various fluid connection means, each comprising one or several conduits or one or several valves 39, 42. One of these valves, the valve 42, guides solvent to 2 possible channels, namely the print head 1 or the ink supply circuit 300. In the latter case, when the means that enable solvent to enter means 300 are themselves closed, solvent is guided to means 50. An anti-pulsation device 411 and a filter 412 may also be arranged in series with the pump.

An intermediate reservoir 141 may also be provided that may be provided with level measurement means 141' and that may be supplied from a cartridge 40, when the cartridge is connected to the circuit.

Preferably, these means 141' comprise an ultrasound sensor that provides good precision for detection of the solvent level.

This reservoir 141 may send solvent to the various means 50, 300 and/or to the print head 1, to clean them or to unblock their hydraulic components; it may also supply solvent to the main reservoir 101. Solvent can also be drawn off from the cartridge 40 and sent directly to the various elements of the circuit, to perform the same operations (cleaning or unblocking or supply of the main reservoir 101). The source of the solvent is selected by a valve 39. The «normally open» (NO) and «normally closed» (NC) positions of each valve are shown on this figure, as on the others. In this case, if the valve 39 is in the «NC» position (FIG. 11), solvent is pumped from the cartridge 40, and if it is in the «NO» position, solvent is pumped from the reservoir 141.

The reservoir 141 may be supplied from the cartridge 40, for example through a calibrated leak or restriction 45 located at its inlet. This leak also participates in generating pressure. The reservoir 141 may be filled as follows; the valve 39 is in the «NC» position (see FIG. 12), so that solvent can be pumped from cartridge 40 through the pump 41. The valve 42 is in the closed (NC) position, while inlets to means 50 and 300 are prohibited to solvent.

Solvent can be sent to these various means 50 (through the conduit 335), 300, then possibly to the main reservoir 101, and/or to the print head 1 (through conduit 337) using valve 42 and means located at the inlet to means 50, 300, for example one inlet valve for each of these means. Therefore, 3 parallel channels are defined at the outlet from means 100 that, depending on the needs, will be used to send solvent to one and/or the other of these elements.

Means 100 may also comprise means 47 forming the pressure sensor, to measure the solvent pressure at the outlet from pump 41 and means 411, 412. This information can be used to detect a pressure increase in the solvent, which can be the result of a blockage in one of the conduits in which solvent flows.

The means 50 comprise a pump ($1^{st}$ pump) that pumps recovered fluid as described above, from the print head, and sends it to the main reservoir 101. This pump is dedicated to recovery of this fluid from the print head and is physically different from the $4^{th}$ pump of means 300 dedicated to transfer of the ink and/or from the $3^{rd}$ pump of means 200 dedicated to pressurisation of the ink at the outlet from reservoir 101.

Figure 13A:
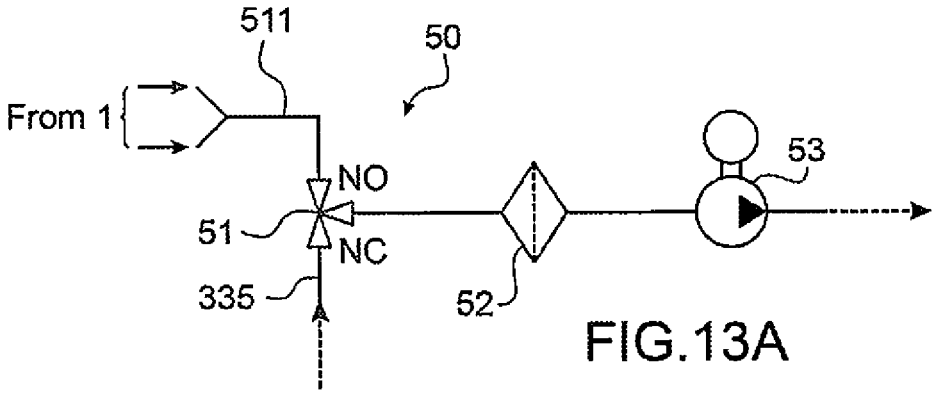
FIGS. 13A and 13B are examples of circuits for recovery from a fluid circuit.

FIG. 13A shows a more detailed representation of one embodiment of means 50 that allow recovery of fluids (ink and/or solvent) that returns from the print head. Therefore, two types of fluid can be brought together at the inlet to these means 50; ink from the recovery gutter 62 (see FIG. 8) and solvent that was used to clean or rinse the print head 1 and/or the umbilical 19. A conduit 511 guides these fluids to the inlet to means 50.

These means comprise a pump 53 (the $1^{st}$ pump), possibly a filter 52 arranged in series with this pump, for example upstream from the pump, and means 51 forming the inlet valve. These means 51 comprise one or several valves, preferably a three-way valve. They exclusively send fluid either from head 1 (NO position of the valve in FIG. 13A) through the conduit 511, or solvent from means 100 (NC position of the valve in FIG. 13A) through the conduit 335, to the pump 53.

Fluid pumped by the pump 53 can then be sent to the main reservoir 10.

Figure 13B:
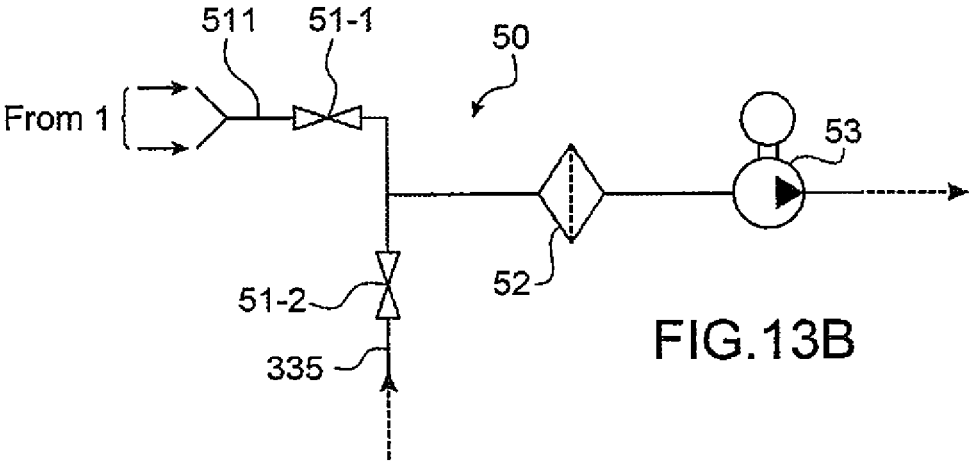

FIG. 13B shows a variant of FIG. 13A. On FIG. 138, 2 valves 51-1 and 51-2 are implemented, instead of a three-way valve. Valve 51-1 is on conduit 511, and makes it possible to interrupt a flow of fluid returning from the print head 1; valve 51-2 is on a conduit through which clean solvent flows, and makes it possible to interrupt or block any flow of said clean solvent towards the pump 53. The other references on FIG. 13B are the same as on FIG. 13A and designate the same technical elements.

Through the control of valves 51-1 and 51-2 (one of said valves being closed while the other one is open), this embodiment achieves the same result as with the one of FIG. 13A: fluid is exclusively sent either from head 1 (open position of valve 51-1 in FIG. 13B and closed position of valve 51-2) through the conduit 511, or solvent from means 100 (open position of the valve 51-2 in FIG. 13B and closed position of valve 51-1) through the conduit 335, to the pump 53.

Fluid pumped by the pump 53 can then be sent to the main reservoir 101.

One example operation of means 100 and 101 will be disclosed below.

Solvent is allowed into means 300, and is then pumped to the main reservoir 101. The solvent path is then the path normally used by ink (FIG. 11, path through conduits 343, 344, 347): valve 35 is changed from the NC state («12») to the NO state (channel»32») and pump 31 is activated to send cleaning solvent to the reservoir 101 (valve 33 being in the «NO» position). Therefore, solvent will supply the reservoir 101, so that in particular the composition of the ink contained in this reservoir can be adjusted.

This may be the case if it is decided to add solvent, in accordance with this invention.

Figure 14:
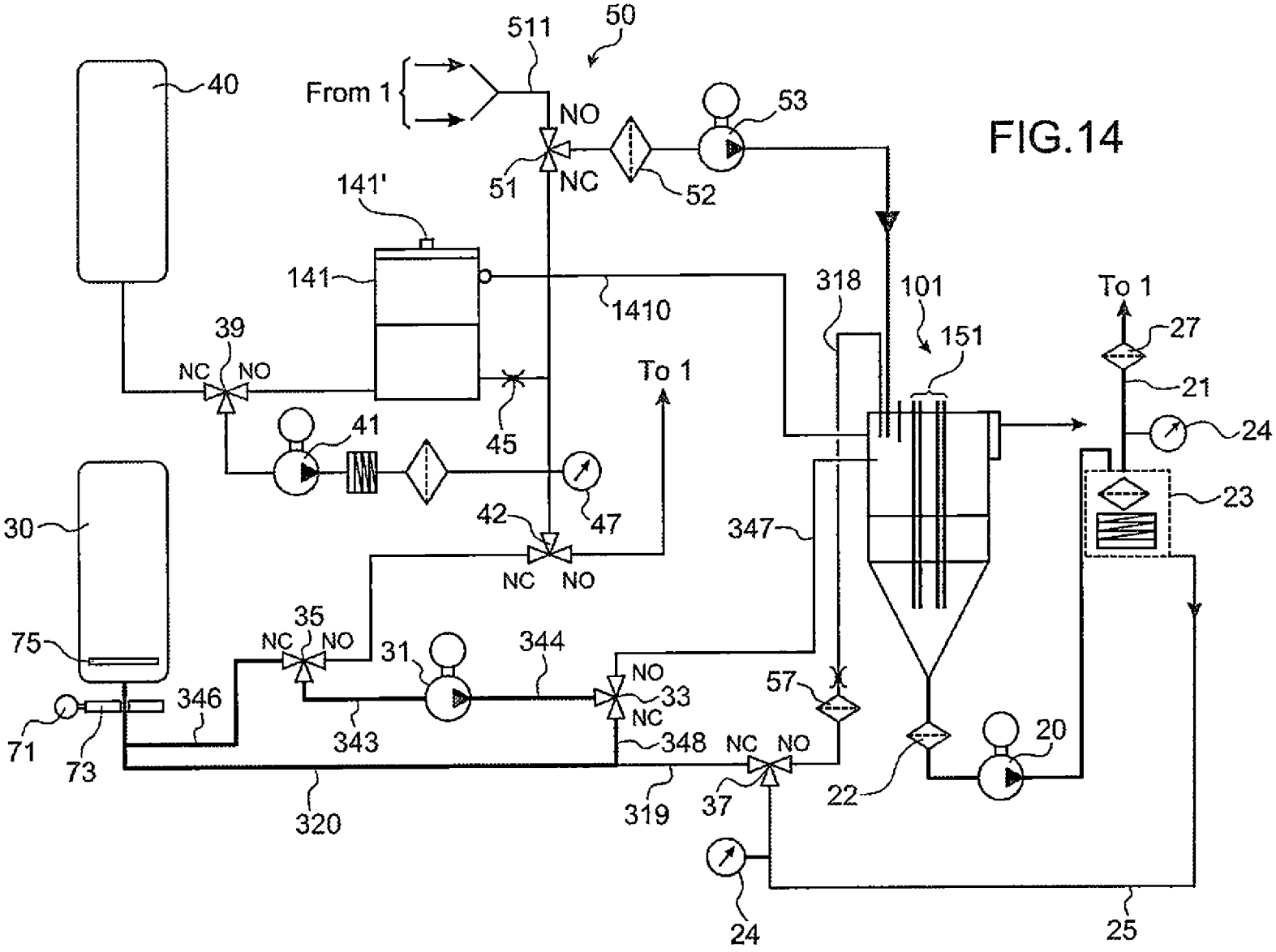
FIG. 14 shows an example of a fluid circuit structure where a cartridge according to the invention can be used.

FIG. 14 shows an in ink circuit in which the circuit and the method described above, particularly with reference to FIGS. 9-13B, can be used. The different means 101, 50, 100, 200, 300 described above are combined. In this figure, numeric references identical to those in the previous figures refer to identical or corresponding elements.

The intermediate reservoir 141 has been described above. A conduit 1410 can be used to bring the free volume located above each of the liquids contained in the reservoirs 101 and 141 to the same atmospheric pressure.

It should be noted that when the valve 42 is in the «NC» position while valve 35 is in the «NC» position, solvent flow is blocked both towards the cartridge 30 and towards the conduit 343; therefore, solvent is thus directed to valve 51 or to restriction 45 (and then enters the intermediate reservoir 141).

The invention is particularly useful for ink containing dense particle dispersions such as metals or metal oxide pigments, for example titanium, zinc, chromium, cobalt or Iron (such as $TiO_2$, ZnO, $Fe_2O_3$, $Fe_3O_4$, etc.) in the form of micronic or sub-micronic particles. Such a pigment ink can for example be based on $TiO_2$, and can be used for marking and identification of black or dark supports.

The invention claimed is:

1. An ink cartridge for a printer, the cartridge including a cartridge shell defining at least one volume of the cartridge, an aperture formed in a wall of the cartridge shell, the aperture being hermetically sealed, a pigmented fluid ink and a magnetic stirrer disposed within the at least one volume and movable with respect to the cartridge shell, wherein both the aperture and the magnetic stirrer are disposed in a lower portion of the cartridge, and wherein said aperture extends through a protuberance formed in said lower portion of said cartridge.

2. The cartridge according to claim 1, wherein the magnetic stirrer is covered with a protecting layer.

3. The cartridge according to claim 1, wherein the cartridge further includes an electronic circuit for storing at least one datum related to at least one physical and/or chemical property of the ink and/or at least one manufacturing and/or expiration date datum of the ink.

4. The cartridge according to claim 1, wherein said cartridge shell is semi-rigid or deformable.

5. The cartridge according to claim 1, wherein the at least one volume is lower than 1 litre.

6. The cartridge according to claim 1, further including a partially obturating element preventing said magnetic stirrer from being accommodated in an inner flow port of the cartridge.

7. The cartridge according to claim 6, wherein the obturating element is disposed inside the cartridge and in the lower portion of the cartridge.

8. The cartridge according to claim 1, said aperture being hermetically sealed with a material having flexibility.

9. The cartridge according to claim 8, wherein the material is rubber.

10. A cartridge compartment of a printer, including:

a compartment volume for receiving a solvent cartridge and an ink cartridge according to claim 1;

hydraulic connections connecting each cartridge to a fluid circuit of the printer;

a motor for moving, in the ink cartridge, the magnetic stirrer with respect to the cartridge shell.

11. The cartridge compartment of a printer according to claim 10, further including a protection to protect said motor.

12. The cartridge compartment of a printer according to claim 10, wherein said motor is provided under the compartment volume for accommodating the ink cartridge in the printer.

13. The cartridge compartment of a printer according to claim 10, wherein said motor can move the magnetic stirrer in the ink cartridge at a frequency of at least 225 Hz.

14. The cartridge compartment of a printer according to claim 10, wherein said motor includes a step motor.

15. The cartridge compartment of a printer according to claim 10, further including a door, that can be opened or closed, said motor being located under said compartment volume when the door is closed.

16. An ink jet printer including:

a printing head;

a circuit for feeding ink and solvent to the printing head; and a cartridge compartment according to claim 10.

17. The ink jet printer according to claim 16, including a pump for pumping a remaining ink from the cartridge, as soon as an ink volume, equal to a minimum ink volume, is reached in the cartridge.

18. The ink jet printer according to claim 16, including a controller controlling the motor to agitate the magnetic stirrer with respect to the cartridge shell, during a printing operation and/or between printing operations and/or during or after a shutdown of the printer.

19. A method for manufacturing an ink cartridge for a printer, including a cartridge according to claim 1, this method including:

introducing a magnetic stirrer in the cartridge shell;

and then introducing ink into the cartridge;

and then hermetically sealing the cartridge.

20. A method for operating an ink jet printer as a continuous jet printer, including a cartridge according to claim 1, including fluidly communicating the inside of the cartridge with an ink feed circuit of the printer, and then moving, with respect to the cartridge shell, said magnetic stirrer, thus stirring the ink in the cartridge.

21. The method according to claim 20, wherein a remaining ink in the cartridge is pumped by the ink feed circuit, as soon as a minimum ink volume is reached in the cartridge.

22. The method according to claim 20, wherein the cartridge, still containing ink, is taken out or withdrawn from the ink feed circuit of said printer and installed in fluid communication with an ink feed circuit of another printer.

23. The cartridge according to claim 1, wherein a holding element is disposed in the at least one volume and holds the magnetic stirrer at a location adjacent said aperture.

24. The cartridge according to claim 23, wherein the holding element is a separating grid.

* * * * *